US005355197A

United States Patent [19]

Hopkins

[11] Patent Number: 5,355,197

[45] Date of Patent: Oct. 11, 1994

[54] METHOD AND APPARATUS FOR PREDICTING THE CYCLE-DOWN BEHAVIOR OF A PHOTORECEPTOR

[75] Inventor: Mark A. Hopkins, Rochester, N.Y.

[73] Assignee: Xerox Corporation, Rochester, N.Y.

[21] Appl. No.: 75,361

[22] Filed: Jun. 11, 1993

[51] Int. Cl.[5] ..... G03G 15/02

[52] U.S. Cl. ..... 355/208; 355/216; 355/219

[58] Field of Search ..... 355/208, 216, 219, 221, 355/223, 225

[56] References Cited

U.S. PATENT DOCUMENTS

| | | | |
|---|---|---|---|
| 4,348,099 | 9/1982 | Fantozzi | 355/71 X |
| 4,512,658 | 4/1985 | Buck et al. | 355/219 |
| 4,796,064 | 1/1989 | Torrey | 355/208 |

*Primary Examiner*—R. L. Moses
*Attorney, Agent, or Firm*—Oliff & Berridge

[57] ABSTRACT

Charges on a photoreceptor dissipate quickly before a latent image enters the development stage of the machine where the image is developed. The photoreceptor's charge potential before entering the developer is called the dark development potential. In order to control the photoreceptor's dark development potential, an adaptive cycle is used to predict the cycle-down effects on the photoreceptor. Charge potential measurements are obtained during the normal print runs and the actual values are used to control the subsequent charging steps. Therefore, the process adapts to the next charging cycle based on the results of the present charging cycle. The method and apparatus adaptively predict the behavior and thereby account for the cycle-down effects when charging the photoreceptor. The method recognizes that in spite of the various parameters that can effect the dark developing potential during cycle-down, the ratio of the variation of the dark developing potential with respect to the predicted steady-state potential is generally constant from one charging cycle to the next. By using a method of deviation ratios, an adaptive prediction of the dark developing potential and also minimized effects due to errors in predicting the level of steady-state of the dark developing potential are achieved.

14 Claims, 6 Drawing Sheets

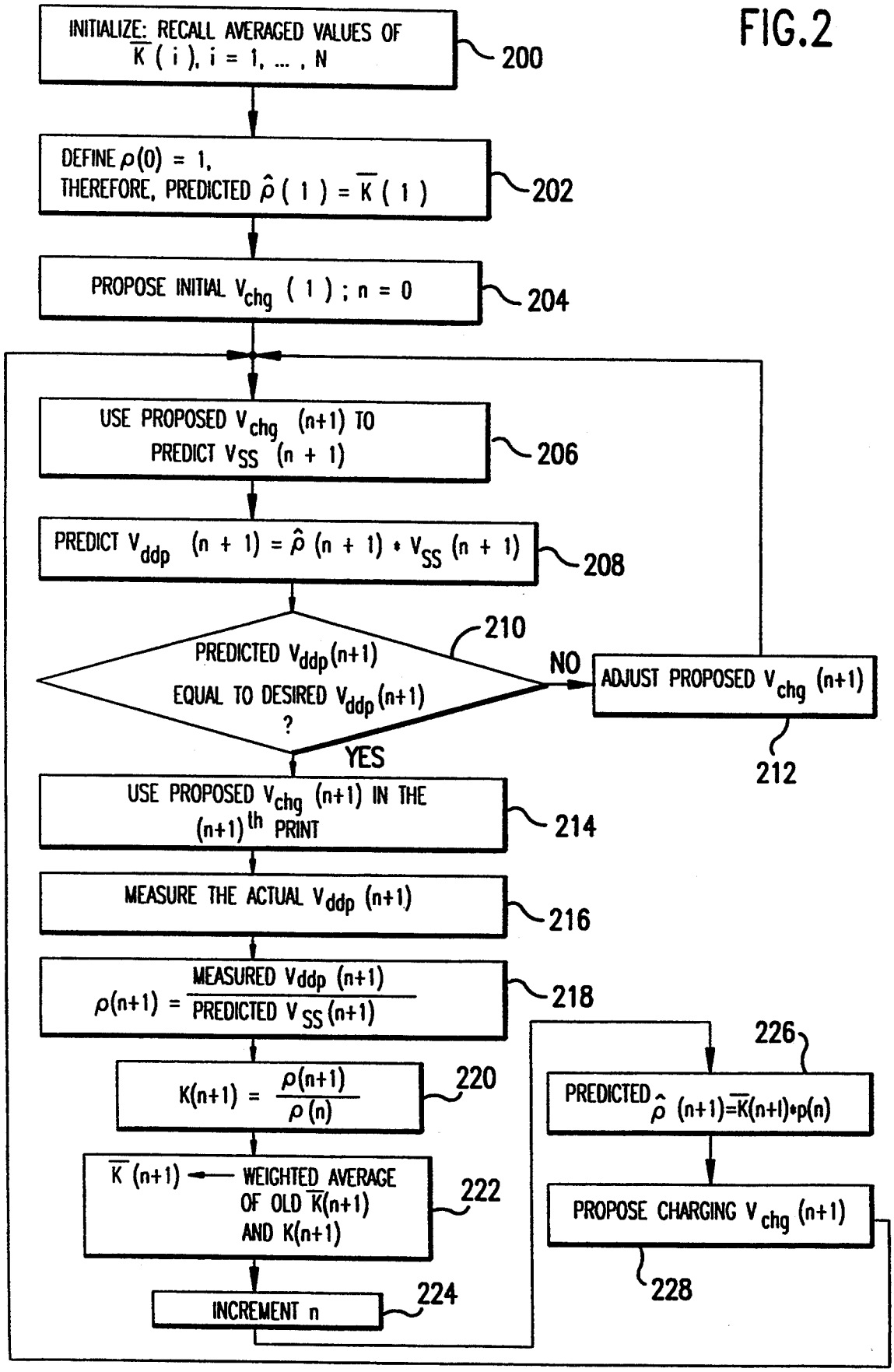
FIG.2
INITIALIZE: RECALL AVERAGED VALUES OF $\overline{K}(i)$, i = 1, ... , N
200
DEFINE $\rho(0) = 1$, THEREFORE, PREDICTED $\hat{\rho}(1) = \overline{K}(1)$
202
PROPOSE INITIAL $V_{chg}(1)$ ; n = 0
204
USE PROPOSED $V_{chg}(n+1)$ TO PREDICT $V_{SS}(n+1)$
206
PREDICT $V_{ddp}(n+1) = \hat{\rho}(n+1) * V_{SS}(n+1)$
208
PREDICTED $V_{ddp}(n+1)$ EQUAL TO DESIRED $V_{ddp}(n+1)$ ?
210
NO
ADJUST PROPOSED $V_{chg}(n+1)$
212
YES
USE PROPOSED $V_{chg}(n+1)$ IN THE $(n+1)^{th}$ PRINT
214
MEASURE THE ACTUAL $V_{ddp}(n+1)$
216
$\rho(n+1) = \frac{\text{MEASURED } V_{ddp}(n+1)}{\text{PREDICTED } V_{SS}(n+1)}$
218
$K(n+1) = \frac{\rho(n+1)}{\rho(n)}$
220
$\overline{K}(n+1) \leftarrow$ WEIGHTED AVERAGE OF OLD $\overline{K}(n+1)$ AND $K(n+1)$
222
INCREMENT n
224
226
PREDICTED $\hat{\rho}(n+1) = \overline{K}(n+1) * \rho(n)$
PROPOSE CHARGING $V_{chg}(n+1)$
228

METHOD AND APPARATUS FOR PREDICTING THE CYCLE-DOWN BEHAVIOR OF A PHOTORECEPTOR

BACKGROUND OF THE INVENTION

1. Field of the Invention

This invention relates to methods and apparatus for predicting the cycle-down characteristics of the photoreceptor. More particularly, through the use of historical values and actual measured values, the characteristics of the decaying charge potential on the photoreceptor can be predicted for the next cycle.

2. Description of the Related Art

In electrophotographic applications such as xerography, a charge retentive surface is electrostatically charged. A photoreceptor belt has a typical charge retentive surface. A light pattern formed from the original image to be reproduced selectively discharges the charge on the photoreceptor. The resulting pattern, a combination of charged and discharged areas on the photoreceptor, form an electrostatic charge pattern (an electrostatic latent image) conforming to the original image. The latent image is developed by contacting it with a finely divided electrostatically attractable powder referred to as "toner". Toner is held on the image area by the electrostatic charge on the surface. Thus, a toner image is produced in conformity with a light image of the original being produced. The toner image may then be transferred to a substrate (e.g., paper), and the toner is fused onto the substrate by passing through a fuser. At this point the image is affixed to the substrate and is ejected from the machine to the holding tray. The process is well known, and is useful for light lens copying from an original, and printing applications from electronically generated or stored originals, where a charged surface may be discharged in a variety of ways. Ion projection devices where a charge is imagewise deposited on a charge retentive substrate operate similarly.

In order for material to be useful as a photoreceptor, it must first be able to accept and maintain charges to relatively high voltage levels. Several hundred volts is a common charge level. Ideally, once charged, the photoreceptor would maintain a constant voltage until exposure to light. The voltage drops to a level near zero after the photoreceptor is exposed to light.

All known photoreceptor materials exhibit non ideal behavior. Photoreceptors cannot maintain a constant non-zero initial voltage level due to several physical mechanisms that tend to dissipate charge. The decay of the unexposed voltage level on a photoreceptor is called the dark development potential ($V_{ddp}$). It is important in developing the contrast characteristics of the latent image. The dark development potential can be expressed as a function of time after the initial charging of the photoreceptor.

In order to use a photoreceptor in a printer or copier, the decay of the dark development potential $V_{ddp}$ needs to be controlled. Therefore, a prediction of the dark development potential $V_{ddp}$ is made after the initial charge is induced on the photoreceptor. If the decay of the dark development potential $V_{ddp}$ were a simple and repeatable function of time after initial charge, then the problem of predicting the dark development potential $V_{ddp}$ level would be trivial. However, dark development potential decay typically is not a simple function because it is dependent upon several parameters some of which are neither constant nor easily measured. The first parameter is the rest time that has occurred since the last use of the photoreceptor. For example, the ability of the photoreceptor to maintain the charge will be different if the last time the photocopier machine was operating was ten minutes ago, last night, or a week ago. The second parameter is the number of copies that were made. For example, if only one copy was made, the charging of the photoreceptor belt will be different than if a thousand copies were made. Third, humidity and temperature may have a small effect on the characteristics of retaining a charge on the photoreceptor belt 10.

Predicting the rate of decay is the main difficulty when dealing with the dark development potential $V_{ddp}$. If a photoreceptor has been idle for a long period, it tends to retain charge well. In contrast, if a photoreceptor is being repeatedly charged and discharged, such as when several prints are made successively, a degradation in charge retention is noticeable. Therefore, the rate of decay of the dark development potential $V_{ddp}$ tends to increase with every successive use of the photoreceptor.

The change in the decay rate of the dark development potential $V_{ddp}$ during successive print cycles is called cycle-down. If successive use continues long enough, cycle-down ends when a steady state condition is reached. In this state, the rate of decay stabilizes or at least changes so slowly that it can be considered reasonably constant. After steady state is reached, the simplest method is to record a sample charging level, a resulting dark developing potential $V_{ddp}$, and the sensitivity of that sample charging level to changes in the charging conditions. The sensitivity is determined during steady state by comparing dark developing potential $V_{ddp}$ measurements under different charging conditions. This method is essentially a linearization of the function in which the data pair (charging conditions, resulting dark developing potential of $V_{ddp}$) becomes the operating point. The sensitivity becomes the slope of linearization.

In the prior art, a method to predict the cycled own effects required a technician to measure the steady state $V_{ddp}$ level during an off-line setup procedure. This information would be entered into a non-volatile RAM. At the beginning of each print run, the controller would take the difference between the measured dark developing potential $V_{ddp}$ and a predetermined steady state dark developing level, to estimate the total cycle-down that will occur. The predetermined fraction of a total cycle-down is assume to occur on each cycle. The problems with this method are: first, a technician is required in the beginning to establish the benchmark levels; second, there are no allowances for inevitable changes in the behavior of the photoreceptor belts over time; and third, there are no allowances for the random variability of behavior in photoreceptors of the same type, or even for the photoreceptor being used.

SUMMARY OF THE INVENTION

The invention predicts the dark development potential $V_{ddp}$ by using the previous history of the photoreceptor belt. The actual dark development potential $V_{ddp}$ is measured in the first cycle. A deviation ratio is calculated for that cycle and is used to predict the deviation ratio in the next cycle. That predicted ratio is then used to predict what the dark development potential $V_{ddp}$ in the next cycle will be. If the predicted potential is not appropriate for the final charge on the photoreceptor, then the controller will adjust the amount of charge which is placed on the photoreceptor in the next cycle.

A preferred embodiment of the invention uses an adaptive method which has the ability to recognize and adapt to change. The method keeps track of historical behavior during cycle-down and uses that to predict behavior of future cycles, because the best information about the next cycle is found in the present cycle. The only aspect of the cycle-down behavior that is germane in a dark developing potential $V_{ddp}$ cycle-down predictor is the amount of deviation from the steady state $V_{ddp}$ that will occur in the next cycle.

The parameters of the decay of the dark developing potential $V_{ddp}$ between charging the photoreceptor and the measurement of the charge just before it is used, i.e., at the developing station, are irrelevant if a prediction of the charge in the next cycle can be made without knowing these decay parameters. The invention predicts only the dark developing potential $V_{ddp}$ that will occur at the fixed electrostatic voltmeter during cycle-down, rather than finding more general parameters of dark developing potential cycle-down and decay functions.

BRIEF DESCRIPTION OF THE DRAWINGS

The invention is illustrated in the accompanying drawings, in which like reference numerals are used to denote like or similar parts, and wherein;

FIG. 2 is a flow diagram for determining the predicted dark developing potential $V_{ddp}$ in the next cycle;

DETAILED DESCRIPTION OF THE PREFERRED EMBODIMENTS

Figure 1:
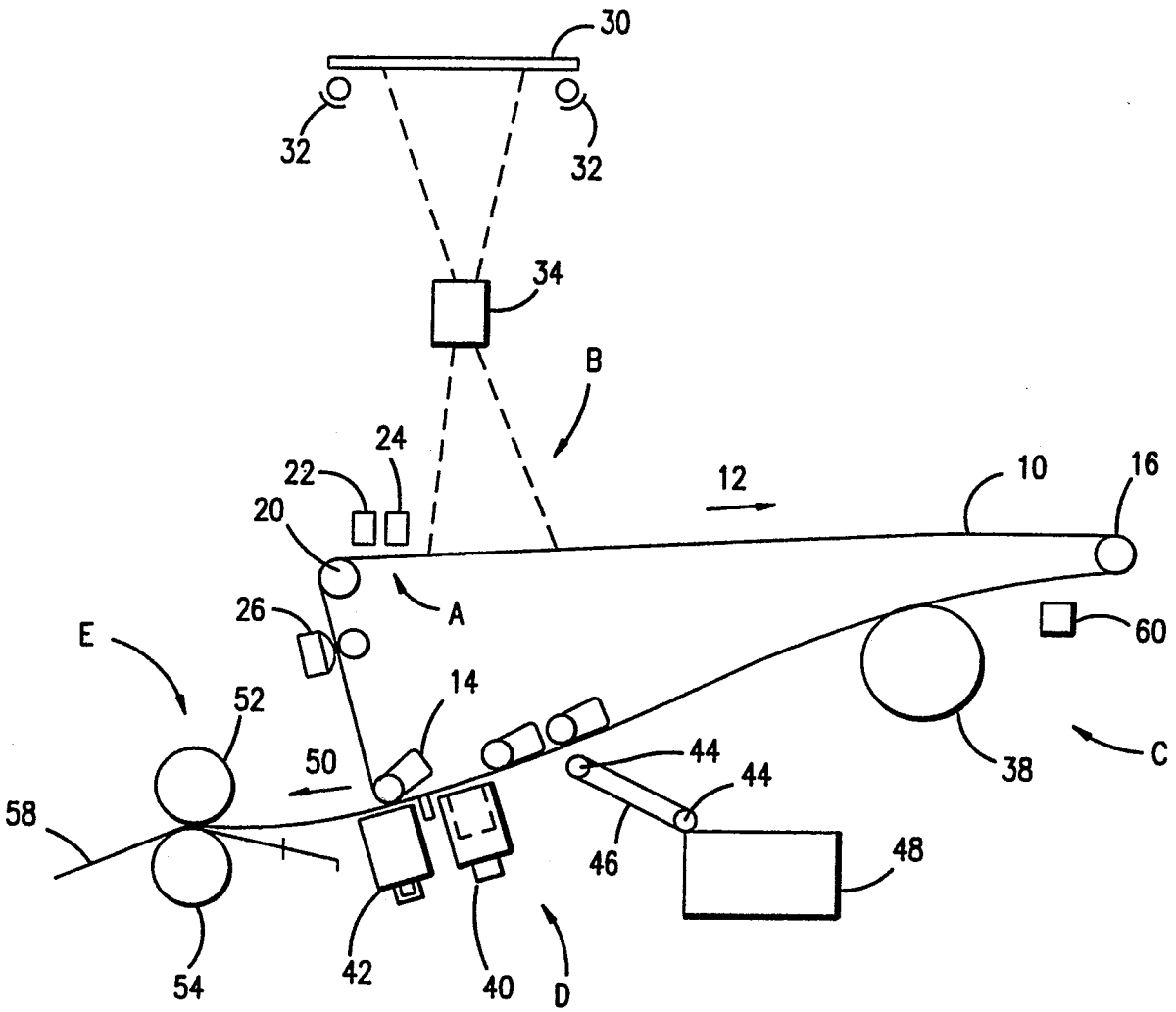
FIG. 1 is a mechanical representations of the xerography machine.

The drawings are for the purpose of describing a preferred embodiment of the invention and not for limiting same. The various processing stations employed in the reproduction machine illustrated in FIG. 1 will be described only briefly. It will no doubt be appreciated that the various processing elements also find advantageous use in electrophotographic printing applications from an electronically stored original.

A reproduction machine of the invention uses a photoreceptor belt 10. Photoreceptor belt 10 moves in the direction of arrow 12 to advance successive portions of the photoreceptor belt 10 sequentially through the various processing stations disposed about the path of movement thereof.

Photoreceptor belt 10 is entrained about stripping roller 14, tension roller 16 and drive roller 20. Drive roller 20 is coupled to a motor (not shown) by suitable means such as a belt drive. Photoreceptor belt 10 is maintained in tension by a pair of springs (not shown) resiliently urging tension roller 16 against photoreceptor belt 10 with the desired spring force. Both stripping roller 14 and tension roller 16 are rotatably mounted. These rollers are also idlers which rotate freely as photoreceptor belt 10 moves in the direction of arrow 12.

To begin the process of making a copy, a portion of the photoreceptor belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of the photoreceptor belt 10 to selectively dissipate the charge thereon. This records an electrostatic latent image on the photoreceptor belt which corresponds to the informational area contained within the original document.

Before the latent image is developed at development station C, the latent image passes an electrostatic voltmeter 60. Thereafter, photoreceptor belt 10 advances the electrostatic latent image to the development station C where a magnetic brush developer unit 38 advances a developer mix (i.e. toner and carrier granules) into contact with the electrostatic latent image. The latent image attracts the toner particles from the carrier granules thereby forming toner powder images on photoreceptor belt 10.

At transfer station D, a sheet of support material such as a copy sheet (paper) is moved into contact with the developed latent image on the photoreceptor belt 10. The copy sheets are advanced by conveyors 46 and rollers 44 from a supply tray 48, which may hold different quantities, sizes and types of support materials. The latent image on photoreceptor belt 10 is transferred to the copy sheet by using transfer corotron 40. The copy sheet with the transferred latent image is the removed from the photoreceptor belt 10 by using a detack corotron 42 and a stripping roller 14.

The copy sheet is advanced to a fusing station E which has a heated fuser roller 52 adapted to be pressure engaged with a pressure roller 54. The transferred toner powder image is permanently affixed to the copy sheets when passing between these rollers. After fusing, the copy sheets are either sent to a decurler (not shown) or advanced to a catch tray through chute 58.

The photoreceptor belt 10 advances toward a cleaner module 26 before being recharged at the charging station A. The cleaner module 26 removes excess toner from the photoreceptor belt 10.

The actual dark developing potential $V_{ddp}$ is typically measured by an electrostatic voltmeter 60 which is installed at a point close to the developer housing in the preferred embodiment. As the photoreceptor belt 10 passes the electrostatic voltmeter 60, a measurement of the electrical charge on the photoreceptor belt 10 is taken. With this measurement, a prediction of the charge in the next cycle can be made. It is only necessary to predict the dark developing potential $V_{ddp}$ that will occur at the electrostatic voltmeter for a given charging condition. Therefore, the parameters of the decay of the charge between charging the photoreceptor belt 10 and measuring the charge are irrelevant.

An area between latent images on the photoreceptor belt 10, commonly called a "test patch," is usually used to measure the dark developing potential $V_{ddp}$. In the preferred embodiments, the test patch is an unexposed area which allows the measurement of the dark developing potential $V_{ddp}$ on every cycle. This will occur regardless of the exposure pattern (latent image) of the document being printed. The exposure pattern may discharge most of the charges in the latent image, therefore the reading of the electrostatic voltmeter of the exposure pattern would not be accurate.

The first preferred embodiment of the present invention uses an adaptive method which has the ability to recognize and adapt to change. The method keeps track of historical behavior during cycle-down and uses that information to predict the behavior of future cycles. Because the best information about the next cycle is found in the present cycle, the only aspect of the cycle-down behavior that is germane is the amount of deviation from the steady state dark developing potential $V_{ddp}$ that will occur in the next cycle.

In developing a process to predict the cycle-down effect, a minimum number of cycles during which cycle-down occurs must be chosen, i.e., the number of cycles until steady state is reached. An underestimate in the number of cycles until steady state must be avoided. Therefore, an over-estimation is made to assure that steady state has been reached by the time the program is complete.

During each cycle-down procedure, the historical information relating to the specific photoreceptor belt 10, such as the deviation from steady state behavior, must be stored. Because many of the parameters affecting cycle-down behavior are variable, the information stored must be relatively independent of these particular parameters. Therefore, knowing the average voltage deviation during cycle-down for a particular path is not sufficient because the average might be very different from the actual deviation that occurs.

The deviation from steady state behavior during the present cycle is a good predictor of the deviation during the next cycle. By expressing this deviation as a ratio, historical behavior can assist in determining future deviations. The deviation ratio during the present cycle can be calculated by the following equation;

$$\rho(n) = \frac{V_{actual}(n)}{V_{SS}(n)} \tag{1}$$

where $\rho(n)$ is the deviation ratio for cycle n; $V_{actual}(n)$ is the actual dark developing potential during the present cycle n (measured by the electrostatic voltmeter); and $V_{SS}(n)$ is the predicted steady state voltage. The steady state voltage is predicted assuming the same charging conditions.

The ratio of deviation ratios is almost a constant value even when many different print runs under widely varying charging and discharging conditions are performed. Therefore, the deviation ratio in a single print run will form a constant. This constant represents a combination of historical calculated constants and the present constant with the following equation;

$$K(n) = \frac{\rho(n)}{\rho(n-1)} \tag{2}$$

where K(n) is the constant in the present cycle; $\rho(n)$ is the deviation ratio of the present cycle; and $\rho(n-1)$ is the deviation ratio of the last cycle. This constant K(n) remains in a range of values depending on the mean variation. The value of the constant in the next cycle K(n+1) can be determined by a simple auto regressive moving average of the ratio of the measured values of the deviation ratios. Thus the program adapts to whatever photoreceptor belt 10 is being used. The program also adapts to changes in the photoreceptor charging characteristics due to aging and other factors.

The availability of the constants of equation 2 becomes central to the prediction of the dark developing potential $V_{ddp}$ in the method of deviation ratios. In the current cycle, the program measures the exact value of the deviation ratio $\rho(n)$. The historical value of the constant K(n+1) allows the algorithm to predict deviation ratio $\rho(n+1)$.

$$\rho(n+1)=K(n+1)\,\rho(n) \tag{3}$$

Taken together with the prediction for the steady state dark developing potential $V_{ddp}$ for the same charging conditions, it yields a prediction of the actual dark developing potential $V_{ddp}$ during cycle-down.

$$\begin{aligned} V_{predicted}(n+1) &= \rho(n)K(n+1)V_{SS}(n+1) \\ &= \rho(n+1)V_{SS}(n+1) \end{aligned} \tag{4}$$

where $V_{predicted}(n+1)$ is the dark developing potential predicted in the next cycle; and $V_{SS}(n+1)$ is the predicted steady state voltage in the next cycle assuming the same charging conditions.

An advantage of using a method of deviation ratios is that it tends to mitigate the errors in predicting the steady state dark developing potential $V_{ddp}$. Some photoreceptors exhibit strange and unpredictable fluctuations in dark developing potential $V_{ddp}$ even in steady state. Errors in steady state prediction are still inevitable because the prediction depends upon knowing the charging sensitivity which is represented by the ratio of the change in dark developing potential $V_{ddp}$ to the change in charging conditions. Sometimes, these charging condition changes can vary quickly. The method of deviation ratios works best if it is used in conjunction with the method that determines the charging sensitivity adaptively. This method is allowed to run beyond the end of the cycle-down into steady state or until the charging sensitivity has been adaptively determined. Once charging sensitivity is known, the steady state dark developing potential $V_{ddp}$ prediction become reliable.

Allowing the method of deviation ratios to run beyond the end of the cycle-down is not detrimental to the voltage predictions. The constant K(n) of equation 2 is unity after cycle-down is finished. Therefore, the program is written for a worst case length of a cycle-down to be used with any photoreceptor. This method does not presume any particular type of cycle-down behavior, therefore, it can be used with any type of photoreceptor material even materials that exhibit non-monotonicity in their cycle-down behavior.

In a second preferred embodiment, equation 4 is not used when predicting the dark developing potential $V_{ddp}$ of the very first cycle. The electrostatic voltage is not measured before the print run actually begins. In some systems a cycle zero is used to determine the state of the photoreceptor belt. The charges on the photoreceptor belt are not used to print an image, therefore it is sometimes called a pre-cycle. In such systems obtaining an accurate prediction of the pre-cycle $V_{ddp}$ is not critically important. It is sufficient to make an approximation. The method can be applied to the task of predicting the cycle zero $V_{ddp}$ before the printing run begins, although incorporating the photoreceptor rest time data produces more accurate predictions for some types of photoreceptors. With the system using a pre-cycle, the method will be adequate.

To apply the method, always assume that the last cycle of the previous print run took place in a steady state condition. Therefore, the deviation ratio of the cycle predicting cycle zero is always equal to unity.

A flow diagram of the invention is shown in FIG. 2. The first steps 200–204 are initialization steps. A pre-cycle test patch may be used to replace these initialization steps to determine the actual $V_{ddp}$. In step 200, the average constant $\overline{K}(n)$ is recalled from memory. The deviation ratio $\rho(0)$ is defined as being equal to 1, and therefore the predicted $\rho(1)$ is equal to the average constant $\overline{K}(1)$. In step 204, an initial charge potential $V_{chg}(1)$ is proposed and n is set to 0.

In step 206, the initial charge potential $V_{chg}(n+1)$ is used to predict $V_{SS}(n+1)$. By using the steady state potential in the next cycle and multiplying it by the deviation ratio of the next cycle $\rho(n+1)$, the predicted dark developing potential $V_{ddp}(n+1)$ is calculated in step 208. In decision step 210, the predicted dark developing potential $V_{ddp}(n+1)$ is compared to the desired dark developing potential $V_{ddp}(n+1)$ of the next cycle. If they are not equal, then step 212 is executed to adjust the initial charge potential $V_{chg}(n+1)$ in the next cycle. Flow is then returned to step 206 to predict the steady state voltage potential. If the decision in step 210 determines that they are equal, then the proposed initial charge potential is used in the next cycle in step 214.

The actual dark developing potential $V_{ddp}(n+1)$ is measured in step 216. The deviation ratio $\rho(n+1)$ is calculated in step 218 by dividing the measured $V_{ddp}(n+1)$ by the predicted $V_{SS}(n+1)$. The constant $K(n+1)$ for the next cycle is predicted by dividing the deviation ratio of the next cycle by the predicted deviation ratio of the present cycle. Step 222 uses the constant $K(n+1)$ of the next cycle to determine the weighted mean average of the constant $\overline{K}(n+1)$ of the next cycle. In step 224, n is incremented by 1 so that the next cycle (n+1) of the previous step becomes the present cycle (n). The deviation ratio $\rho(n+1)$ of the next cycle is predicted in step 226 by multiplying the weighted mean average of the constant $\overline{K}(n+1)$ by deviation ratio $\rho(n)$. In step 228, a new proposed initial charge potential $V_{chg}(n+1)$ is chosen. Flow is then returned to step 206 to determine the charge to be placed on the photoreceptor in the next cycle.

Once the predicted dark developing potential $V_{ddp}$ is determined, the value is sent to a controller which adjusts the voltage potential applied to the photoreceptor belt 10. Flow is returned to step 202 to measure the actual dark developing potential $V_{ddp}(n+1)$ which will be used in the present cycle.

Figure 3:
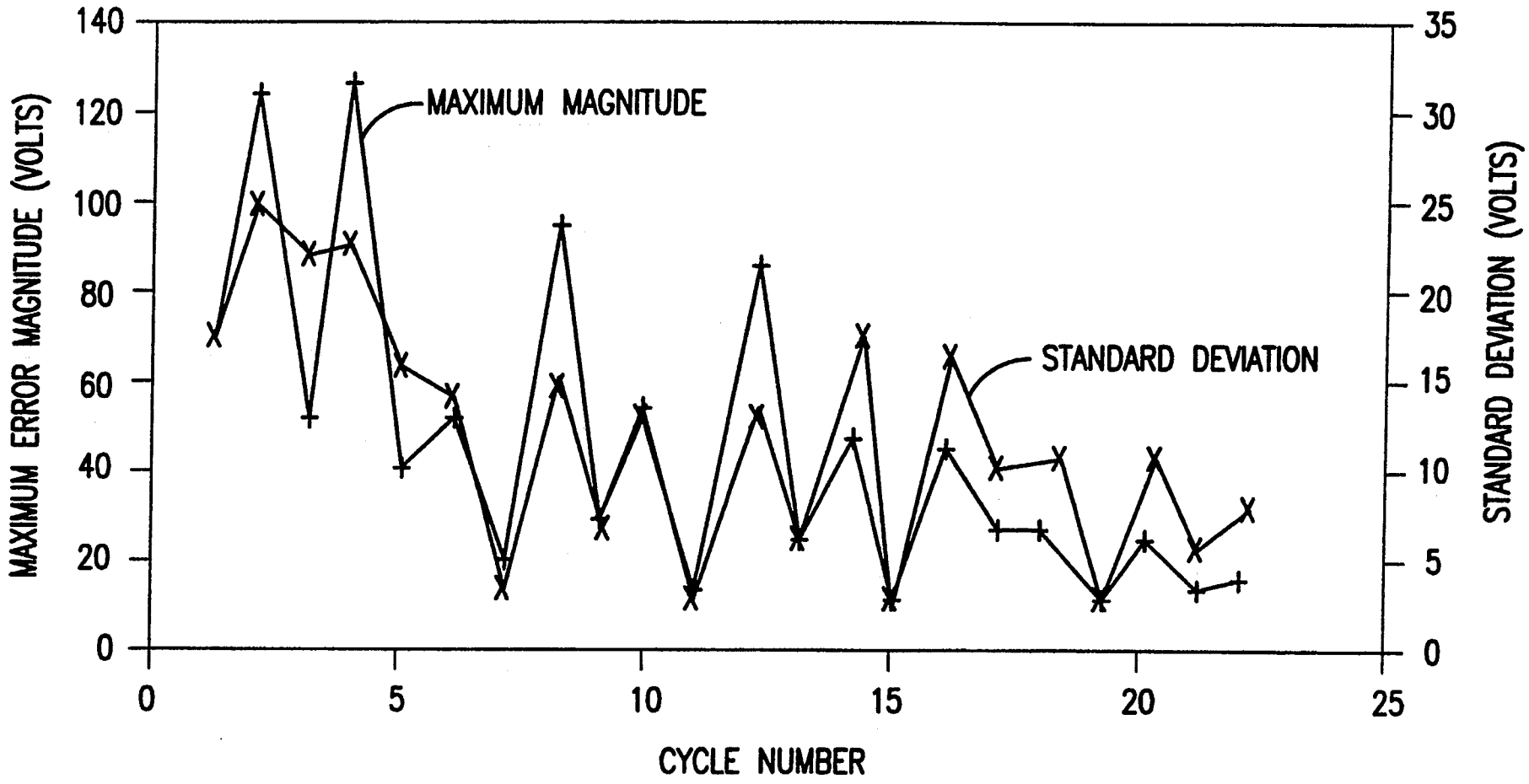
FIG. 3 is a graph showing the characteristics of a photoreceptor using a controller of the prior art.

Now referring to FIG. 3, the maximum error and standard deviation characteristics of a $V_{ddp}$ controller without an adaptive cycle-down program is shown. In this type of system, the total cycle-down is determined at the beginning of each print run; but the rate of cycle-down is always assumed to be the same. This means that a fixed fraction of the cycle-down is assumed to occur during each cycle. The photoreceptor belt used for testing had particularly difficult cycle-down characteristics. Also, the 60 print runs had a very wide range of rest times. By examining the characteristics, several problems with the controller are apparent. First, the cycle-down effects are non-monotonic and vary over a large range in an unpredictable and apparently random way. Second, the testing continued for about 20 cycles and the worst errors occurred in the first five cycles. Third, the magnitudes of the error often exceed 100 volts. In fact, the maximum $V_{ddp}$ error magnitude that occurred on the first cycle in any of the print runs is about 125 volts. The standard deviation of the $V_{ddp}$ errors was about 22 volts.

Figure 4:
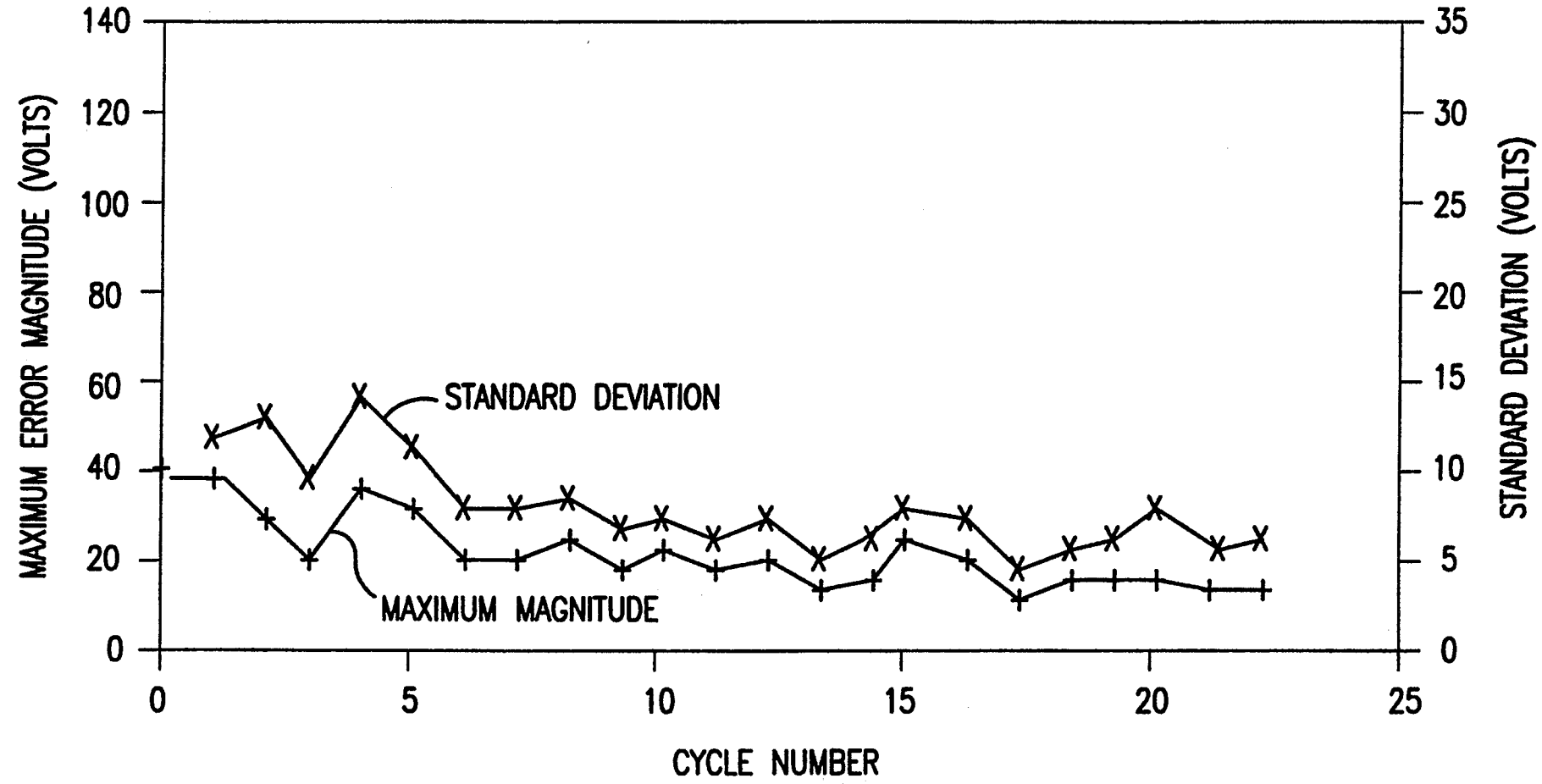
FIG. 4 is a graph showing the characteristics of a photoreceptor using a controller with an adaptive cycle-down program.

Referring to FIG. 4, the maximum error and standard deviation characteristics of a $V_{ddp}$ controller with an adaptive cycle-down program are shown. As in the previous test shown in FIG. 3, data was collected from a large number of print runs and under widely varying photoreceptor rest conditions. The maximum $V_{ddp}$ error magnitude that occurred on the fourth cycle in any of the print runs is about 37 volts. This is a substantial decrease from the 125 volts using the controller without an adaptive cycle-down program. Similarly, the standard deviation of the $V_{ddp}$ errors on the fourth cycle of all the print runs was about 14 volts using the method of the preferred embodiment. As can be seen from FIG. 4, the standard deviation of the $V_{ddp}$ errors is very close to the steady state value after only five cycles even though the cycle-down effects continue until about 20 cycles.

Figure 5:
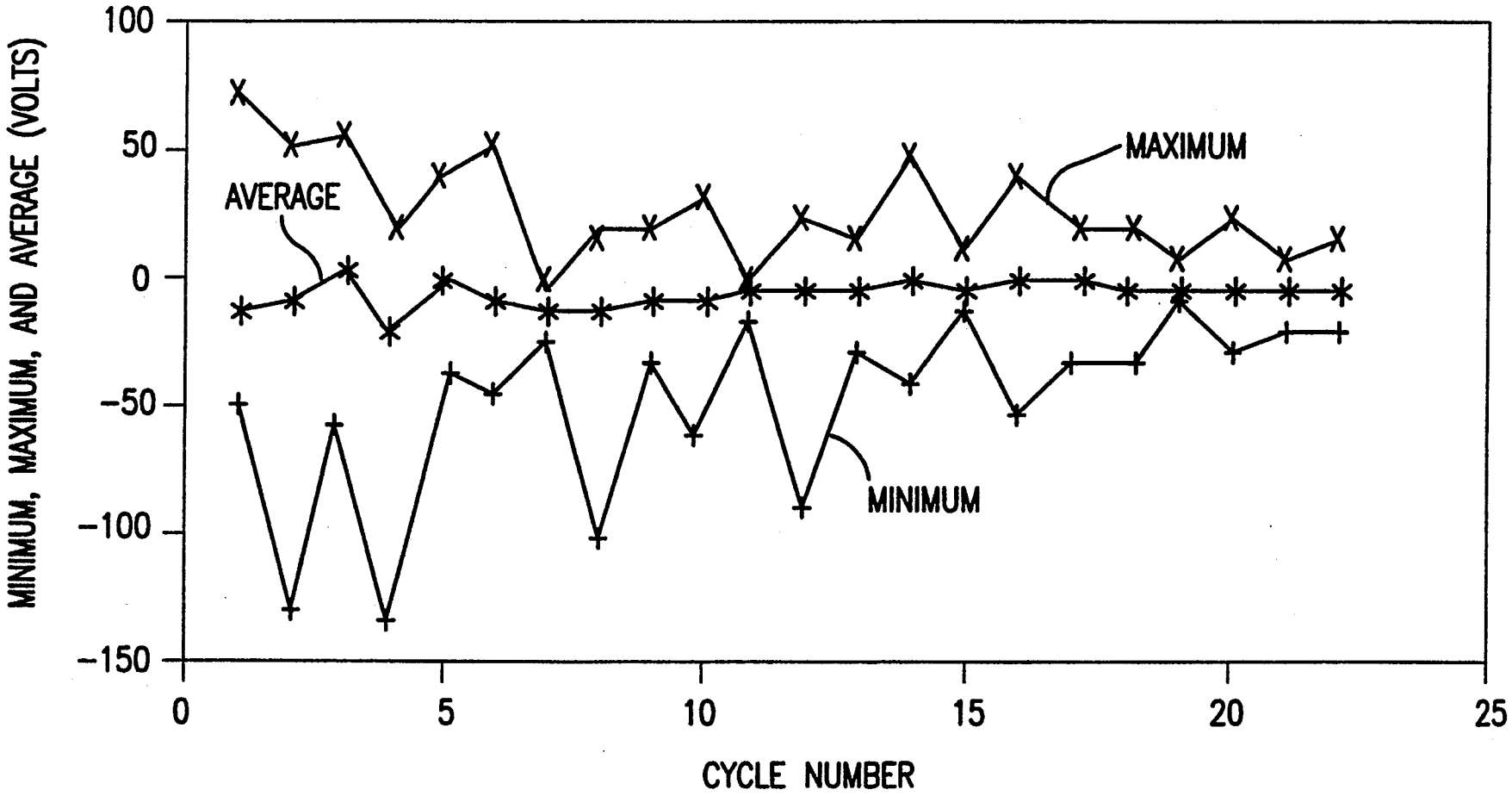
FIG. 5 is a graph showing the maximum, minimum and average error using a controller of the prior art.
Figure 6:
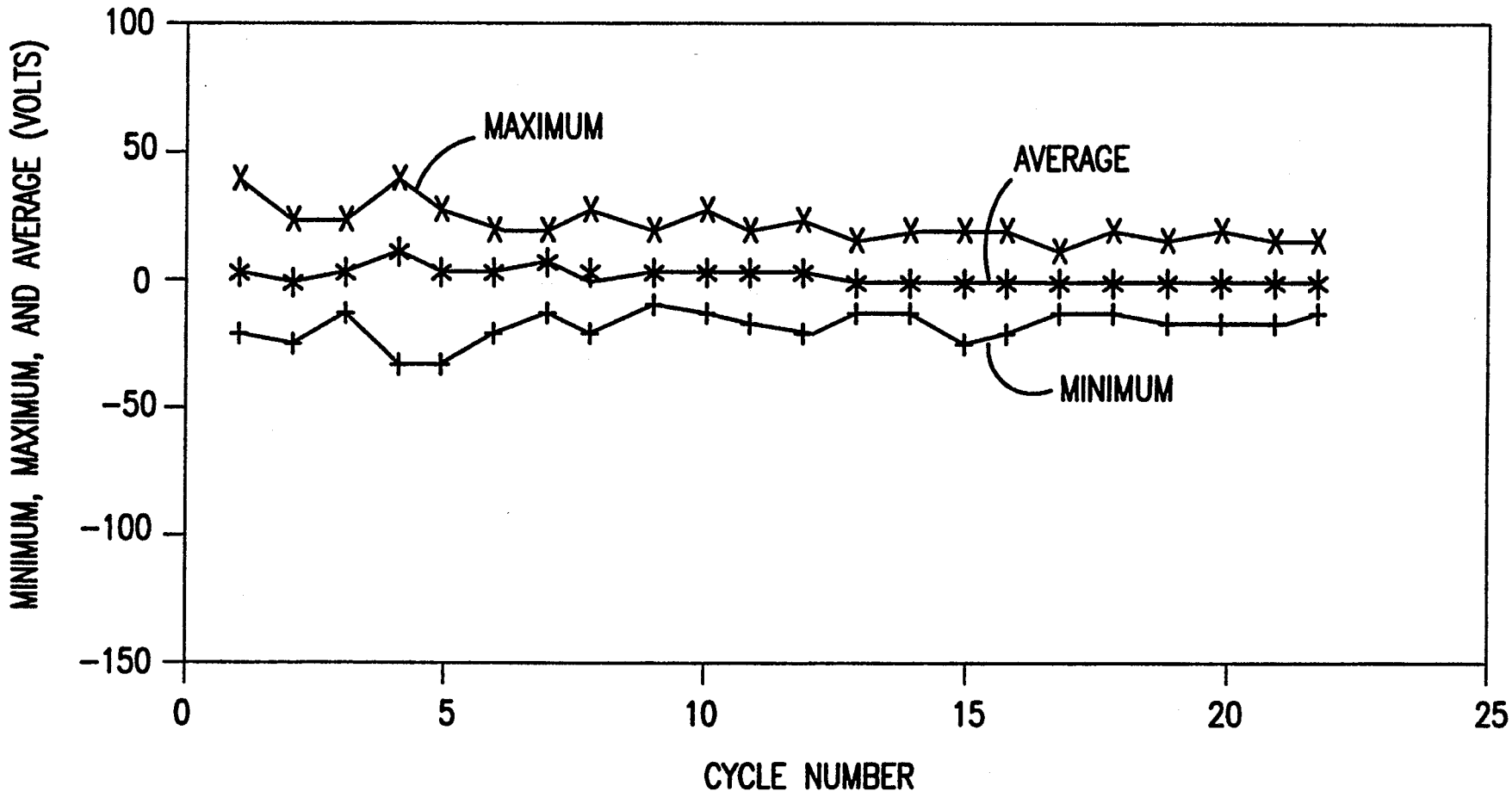
FIG. 6 is a graph showing the maximum, minimum and average error using a controller with an adaptive cycle-down program.

Referring to FIGS. 5 and 6, the overall minimum error, maximum error and average error are shown for a collection of print runs. FIG. 5 uses a $V_{ddp}$ controller with a non-adaptive cycle-down program. In the first few cycles, the difference between the maximum and minimum values is large. The magnitudes are not even close to each other until the sixth cycle.

FIG. 6 shows the error characteristics of a $V_{ddp}$ controller with an adaptive cycle-down program of the preferred embodiment. The minimum and maximum of $V_{ddp}$ errors are very close to steady state levels by the second or third cycle. The cycle-down effects continue until about cycle 20.

Although the invention has been described and illustrated with particularity, it is intended to be illustrative of preferred embodiments. It is understood that the disclosure has been made by way of example only. Numerous changes in the combination and arrangement of the parts, steps, and features can be made by those skilled in the art without departing from the spirit and scope of the invention, as herein claimed.

What is claimed is:

1. A method for determining a dark development potential of a photoreceptor in a subsequent cycle during a cycle-down procedure, an initial charge potential in a present cycle being applied to the photoreceptor which loses some charge potential between a point of charging the photoreceptor and a point of using the charge potential remaining on the photoreceptor, comprising the steps of:

measuring the dark development potential on the photoreceptor in the present cycle;

determining a deviation ratio for the subsequent cycle based on a moving average constant and the measured dark development potential in the present cycle; and predicting the dark development potential on the photoreceptor for the subsequent cycle based on the deviation ratio and the initial charge potential to be applied in the subsequent cycle.

2. A method according to claim 1, wherein the predicting step is reiterated until the dark development potential is equivalent to a desired dark development potential in the subsequent cycle by changing the initial charge potential to be applied to the photoreceptor in the subsequent cycle.

3. The method according to claim 1, wherein the measuring the dark development potential is performed by an electrostatic voltmeter.

4. The method according to claim 1, wherein the measuring of the dark development potential is performed close to a developer used to develop a latent image on the photoreceptor.

5. The method according to claim 1, wherein determining the deviation ratio in the subsequent cycle comprises the steps of:

determining the deviation ratio in the present cycle based on the measured dark development potential in the present cycle and the initial charge potential in the present cycle;

calculating a constant for the present cycle based on the deviation ratio of the present cycle and the deviation ratio of a preceding cycle;

determining the constant for the subsequent cycle; and determining the deviation ratio in the subsequent cycle based on the deviation ratio of the present cycle and the constant of the subsequent cycle.

6. The method according to claim 5, wherein the deviation ratio in the present cycle is determined by the following equation:

$$\rho(n) = \frac{V_{actual}(n)}{V_{SS}(n)}$$

where $\rho(n)$ is the deviation ratio for the present cycle, $V_{actual}(n)$ is the dark development potential during the present cycle, and $V_{SS}(n)$ is the predicted steady state voltage in the present cycle.

7. The method according to claim 5, wherein the constant of the present cycle is calculated by the following equation:

$$K(n) = \frac{\rho(n)}{\rho(n-1)}$$

where $K(n)$ is the constant in the present cycle, $\rho(n)$ is the deviation ratio of the present cycle, and $\rho(n-1)$ is the deviation ratio of the preceding cycle.

8. The method according to claim 5, wherein the constant for the subsequent cycle is determined by an auto regressive moving average of a ratio of the deviation ratios.

9. The method according to claim 5, wherein the deviation ratio in the subsequent cycle is determined by the following equation:

$$\rho(n+1)=K(n+1)\,\rho(n)$$

where $\rho(n)$ is the deviation ratio of the present cycle, and $K(n+1)$ is the constant for the subsequent cycle.

10. The method according to claim 1, wherein predicting the dark development potential in the subsequent cycle is determined by the following equation:

$$V_{predicted}(n+1)=\rho(n+1)\,V_{SS}(n+1)$$

where $V_{predicted}(n+1)$ is the dark development potential predicted for the subsequent cycle, and $V_{SS}(n+1)$ is the predicted steady state voltage in the subsequent cycle assuming the same charging conditions.

11. An apparatus for controlling a dark development potential of a photoreceptor in a subsequent cycle during a cycle-down procedure, an initial charge potential being applied to the photoreceptor which loses some charge potential between a point of charging the photoreceptor and a point of using the charge potential remaining on the photoreceptor, comprising:

a charge applicator for applying an initial charge potential on the photoreceptor in the present cycle;

a meter for measuring the dark development potential on the photoreceptor in the present cycle;

a controller determining the amount of initial charge to apply to the photoreceptor in the subsequent cycle based on predicting the dark development potential for the subsequent cycle by using a moving average constant of deviation ratios and the measured dark development potential of the present cycle.

12. The apparatus according to claim 11, wherein the meter is an electrostatic voltmeter.

13. The apparatus according to claim 11, wherein the charge applicator is a corotron which can generate and apply different charge potentials to the photoreceptor.

14. The apparatus according to claim 11, wherein the controller is a computer.

* * * * *